US006387018B1

(12) United States Patent
Krull

(10) Patent No.: US 6,387,018 B1
(45) Date of Patent: May 14, 2002

(54) METHODS AND APPARATUS FOR ADJUSTING RESISTANCE TO EXERCISE

(76) Inventor: Mark A. Krull, P.O. Box 57, Greencastle, IN (US) 46135

( * ) Notice: Subject to any disclaimer, the term of this patent is extended or adjusted under 35 U.S.C. 154(b) by 0 days.

(21) Appl. No.: 09/687,675

(22) Filed: Oct. 13, 2000

Related U.S. Application Data

(60) Provisional application No. 60/159,866, filed on Oct. 15, 1999, and provisional application No. 60/162,291, filed on Oct. 28, 1999.

(51) Int. Cl.[7] ..... A63B 21/06

(52) U.S. Cl. ..... 482/98; 482/99

(58) Field of Search ..... 482/93, 94, 97–103, 482/136–138, 148, 908

(56) References Cited

U.S. PATENT DOCUMENTS

| | | | | |
|---|---|---|---|---|
| 4,627,615 A | 12/1986 | Nurkowski | ..... | 482/98 |
| 4,765,611 A | 8/1988 | MacMillan | ..... | 482/98 |
| 4,809,973 A | 3/1989 | Johns | ..... | 482/98 |
| 4,834,365 A | 5/1989 | Jones | ..... | 482/99 |
| 5,643,152 A | 7/1997 | Simonson | ..... | 482/98 |
| 5,776,040 A | 7/1998 | Webb et al. | ..... | 482/98 |
| 6,193,635 B1 * | 2/2001 | Webber et al. | ..... | 482/98 |

FOREIGN PATENT DOCUMENTS

| | | | | |
|---|---|---|---|---|
| FR | 2613237 | 10/1980 | ..... | 482/99 |
| JP | 10-118222 | 5/1998 | ..... | 482/98 |
| SU | 1347948 | 10/1987 | ..... | 482/98 |
| SU | 1443898 | 12/1988 | ..... | 482/98 |

OTHER PUBLICATIONS

Bodybuilder's Discount Outlet Summer 1995 catalog, p. 23.*

Cybex Strength Systems (Brochure) © 1994 (6 pages).

* cited by examiner

*Primary Examiner*—John M. Mulcahy

(57) ABSTRACT

Supplemental weights are selectively movable into and out of a path traversed by the top plate in a weight stack. Preferably, the supplemental weights include a half-weight and a quarter-weight which are movable in any combination into the path of the top plate and into concentric alignment with the top plate.

14 Claims, 11 Drawing Sheets

Fig. 12
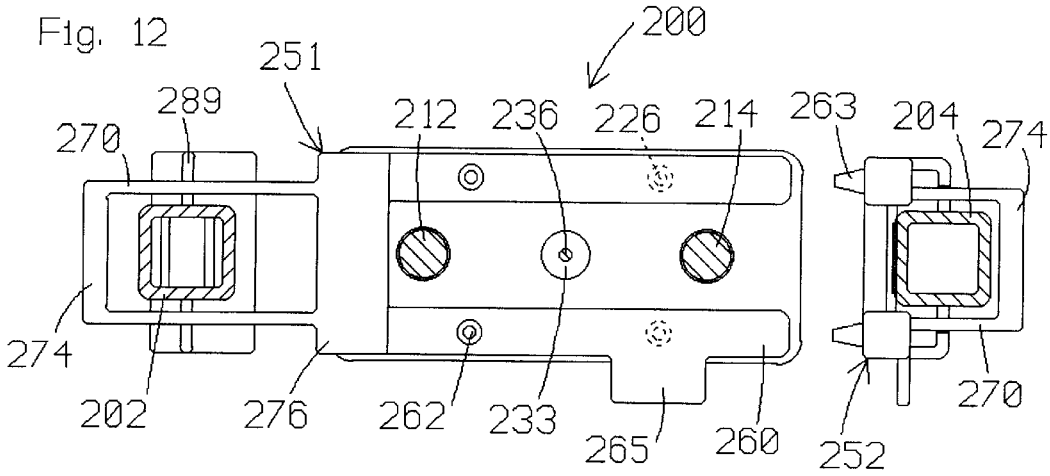
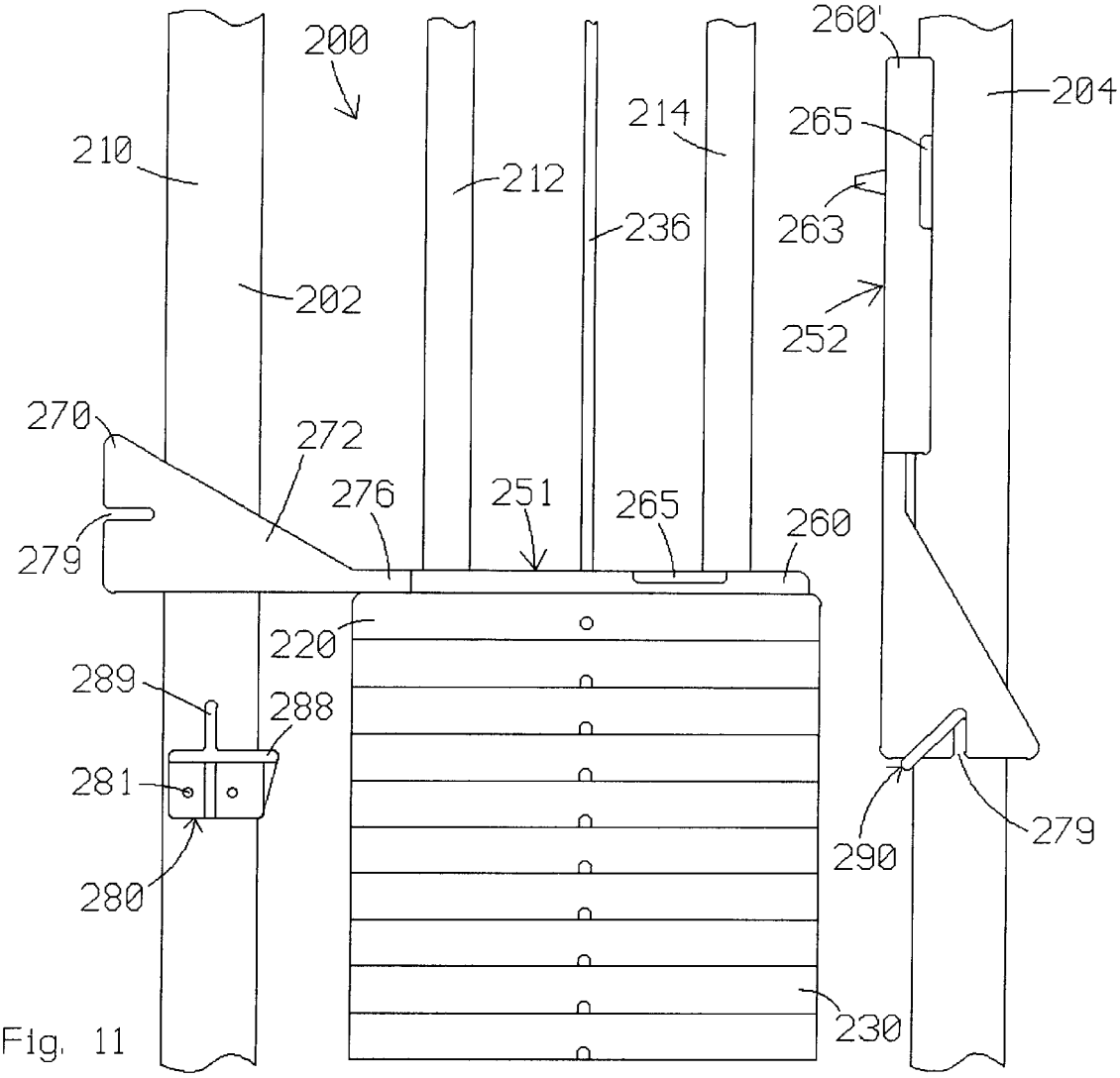
Fig. 11

Fig. 13
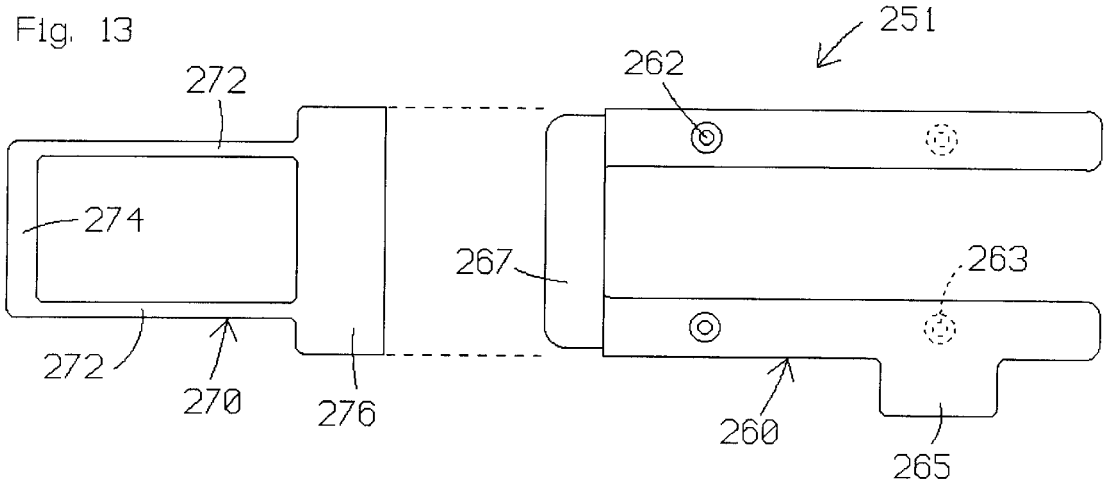
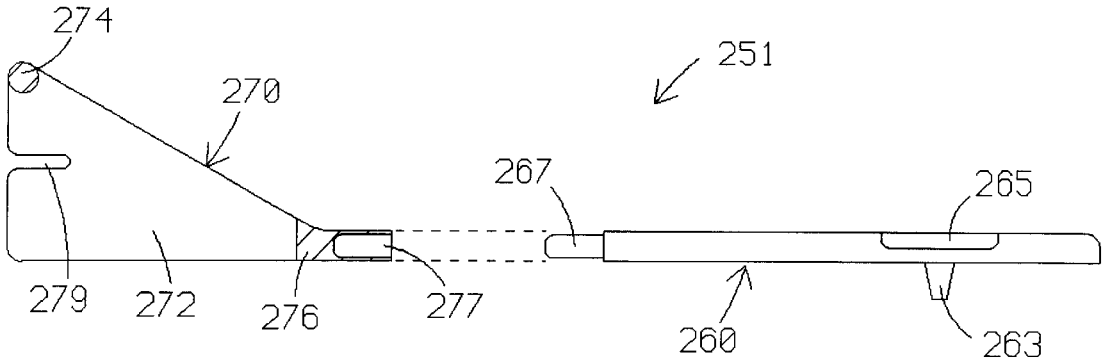
Fig. 14
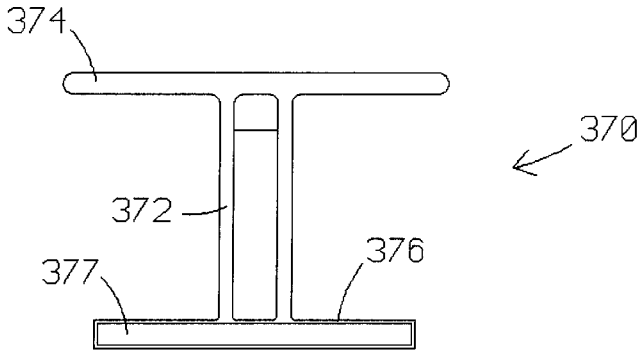
Fig. 21

Fig. 23
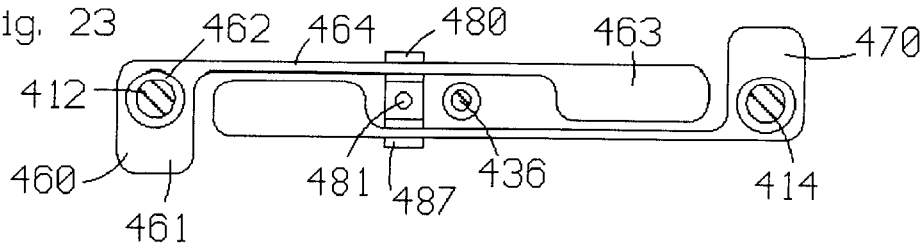
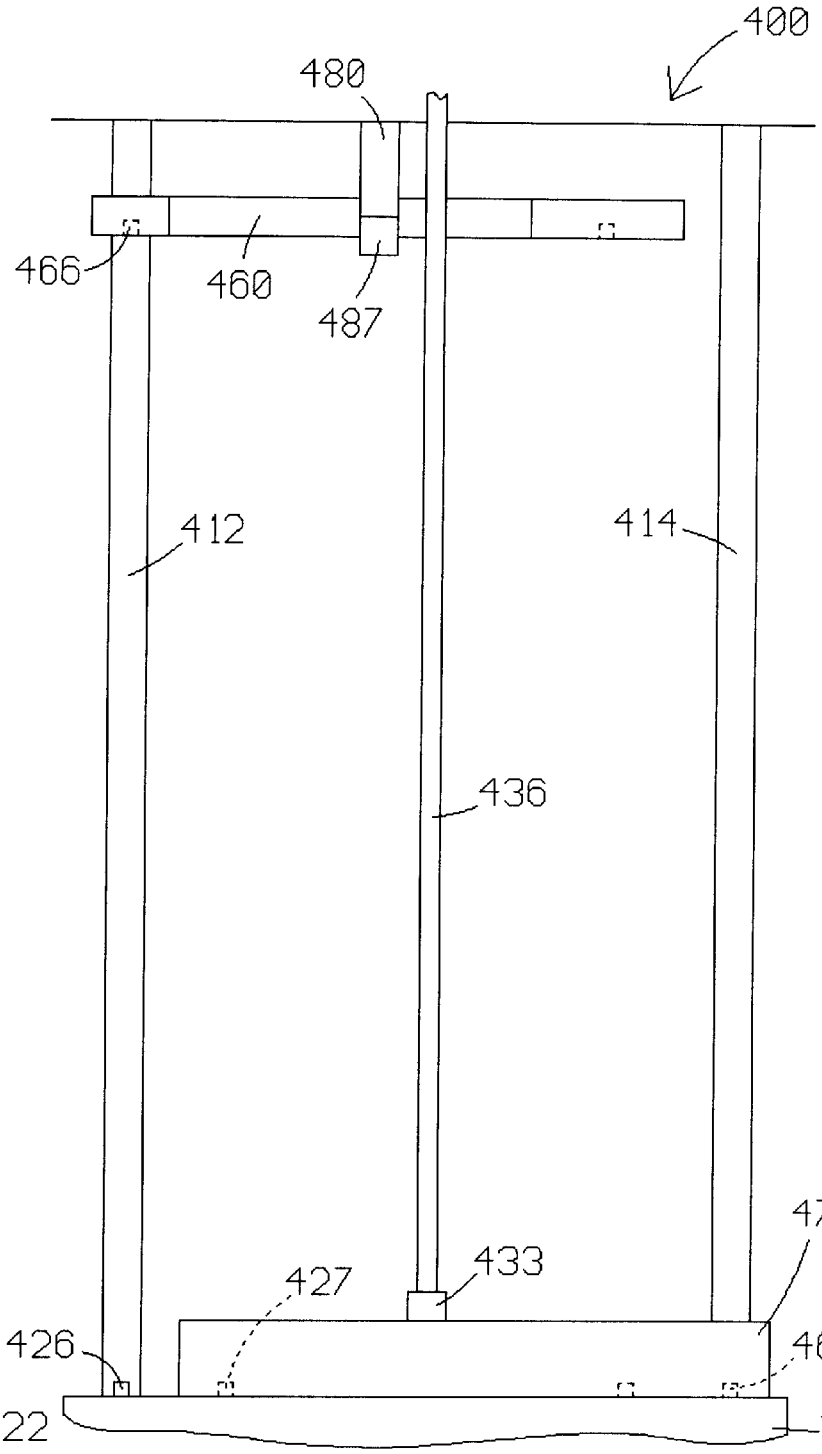
Fig. 22

Fig. 25
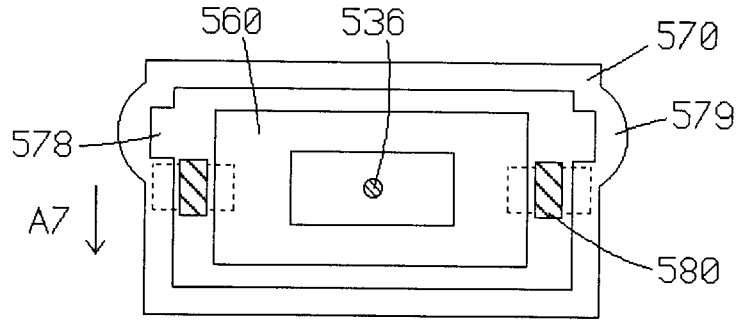
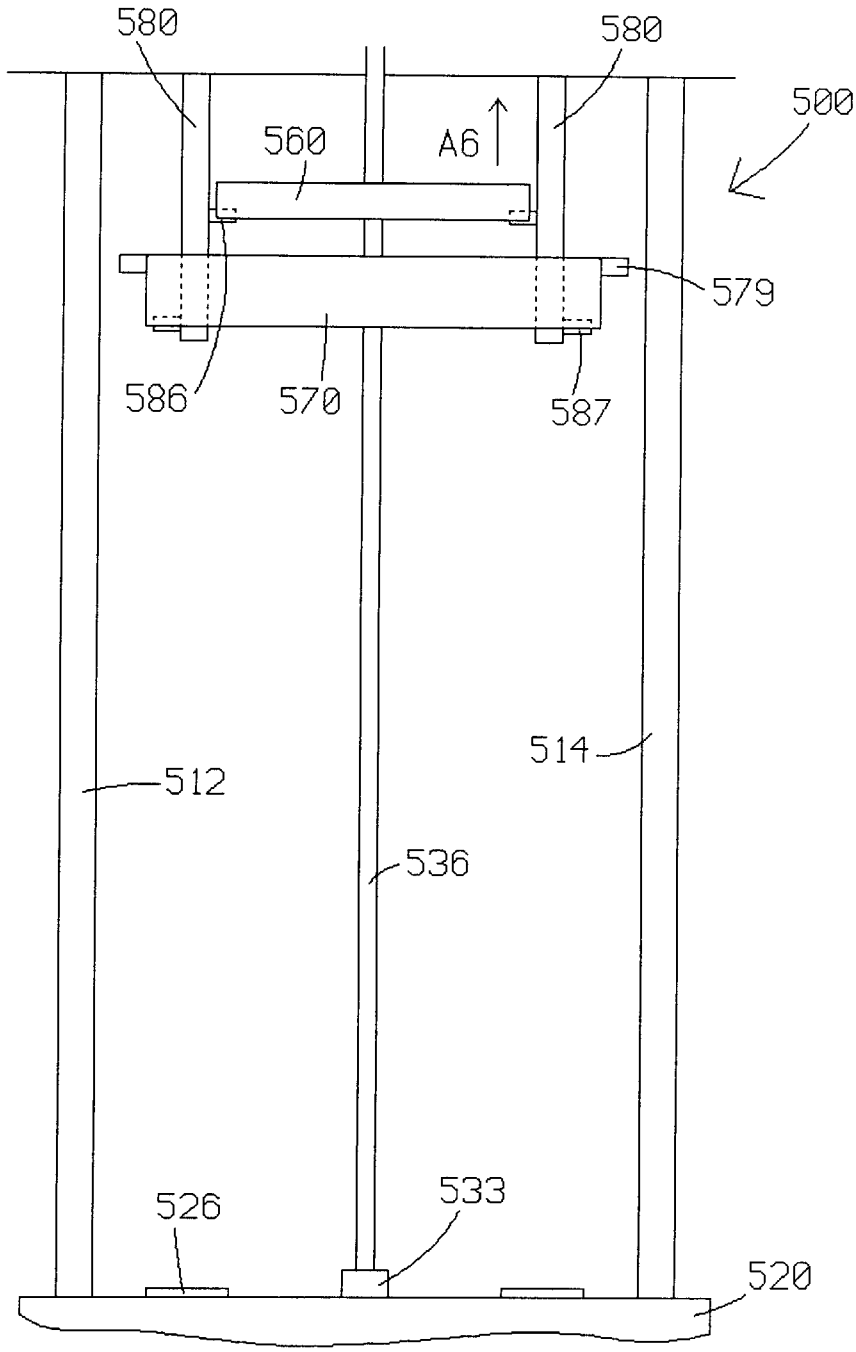
Fig. 24

METHODS AND APPARATUS FOR ADJUSTING RESISTANCE TO EXERCISE

This Appln claims benefit of Prov. No's. 60/159,866 filed Oct. 15, 1999 and 60/162,291 filed Oct. 28, 1999.

FIELD OF THE INVENTION

The present invention relates to exercise equipment and more particularly, to exercise equipment that uses a variable number of weights to resist exercise motion.

BACKGROUND OF THE INVENTION

Exercise weight stacks are known in the art. Generally speaking, weights are arranged in a stack and movably mounted on at least one guide rod or rail. A selector rod is connected to a desired number of weights by a pin (or other suitable means known in the art). The selector rod and any selected weights are connected to a force receiving member by a cable (or other suitable means known in the art) which moves the weights upward in response to exercise movement.

Although exercise weight stacks are prevalent in the exercise industry, they nonetheless suffer from certain shortcomings. For example, in order to provide a large amount of weight at a reasonable cost and within a reasonable amount of space, equipment manufacturers use a small number of relatively heavy weights. As a result, the amount of weight being lifted cannot be adjusted in small increments. On the other hand, a relatively large number of lighter weights could be used in order to provide smaller increments in weight adjustment, but the resulting equipment would be relatively more expensive and/or bulky.

Attempts have been made to address the issue of incremental adjustments. One such approach involves the provision of a loose half-weight which is available for movement onto the top plate at the discretion of a user. This particular arrangement is not well suited for institutional environments because the half-weight may be lost or misused. Another prior art approach involves the provision of a half-weight (or other fractional weight), which weighs one-half the weight of each weight in the stack, and which is selectively movable from a peg on the frame onto an aligned peg on the top plate of the stack. This approach not only fails to overcome the possibility of losing the half-weight, but it also creates a balance problem during movement of the selected weights, and increases the potential for injury due to the proximity of the two pegs and their movement relative to one another. Yet another prior art approach involves the provision of a second, adjacent weight stack comprising weights which weigh a fraction of the weights in the primary weight stack. Unfortunately, this approach adds significantly to both the cost and the size of the equipment.

Yet another prior art machine with supplemental weights is disclosed in French Patent No. 2,613,237 to Louvet. The Louvet machine includes a stack of primary weights movable along a guide rod in response to exercise movement, and a stack of secondary weights movable along the guide rod and selectively stored above the stack of primary weights. The secondary weights are supported by gates which are rotatably mounted on rigid frame members and which have pegs that rotate into engagement with holes in the frame members. Each of nine secondary weights has a mass equal to one-tenth the mass of one of the primary weights. One disadvantage of the Louvet machine is that nothing prevents a user from releasing a secondary weight without grasping the weight being released. As a result, the secondary weight may be free to drop downward onto the top plate in the stack of primary weights, thereby increasing the likelihood of personal injury and/or damage to the machine. Also, each of the secondary weights is not separately supported by a respective gate. As a result, the entire stack of secondary weights may be released at one time, with or without a user holding onto to any of the secondary weights. Yet another shortcoming of the Louvet machine is that nine secondary weights are required to provide nine levels of incremental weight adjustments.

Still other prior art approaches are disclosed in Soviet Union Patent No. 1347-948-A and Japan Patent No. 10-118222. Each of these patents discloses first and second supplemental weights which are movably mounted on discrete guide rods outside the planform of the primary weight stack. The supplemental weights in the Soviet patent are pivotally mounted on respective guide rods for movement into the path of the primary weight stack. The supplemental weights in the Japan patent are releasably secured to the top plate by a separate selector pin. A shortcoming common to both of these approaches is the need for separate guide rods for the supplemental weights, and/or they impose non-aligned weight on the primary weight stack. In other words, despite all of the efforts discussed above, room for better solutions and/or improvements remains.

SUMMARY OF THE INVENTION

One aspect of the present invention is to provide an exercise apparatus with a frame and a weight stack movably mounted relative to the frame. The weight stack includes a top plate which is movable along the frame between a lowermost position and an uppermost position. A connector is interconnected between the top plate and a force receiving member. A first supplemental weight is preferably movable along the frame and/or the connector, and a second supplemental weight is preferably movable along the frame and/or the connector. Each supplemental weight is selectively movable between a rest position, outside the path of the top plate and preferably supported by the frame, and an operative position, supported by the top plate. The supplemental weights are movable between positions in any order, and they are concentrically aligned with the top plate when in the operative position.

On a first embodiment of the present invention, the first supplemental weight is movable along a first weight stack guide rod, and the second supplemental weight is movable along a second weight stack guide rod. The supplemental weights are supported by supports on the frame when in the rest position, and they are rotatable out of engagement with the supports for movement to the operative position. Pegs on the top plate register with holes in the supplemental weights to maintain the latter in concentric alignment with the former when in the operative position.

On a second embodiment of the present invention, the supplemental weights are movable along the connector and configured to concentrically nest relative to one another. The supplemental weights are supported by supports on the frame when in the rest position, and they are maneuverable out of engagement with the supports for movement to the operative position. Bosses on the top plate register with recesses in the supplemental weights to maintain the latter in concentric alignment with the former when in the operative position.

On a third embodiment of the present invention, the supplemental weights are movable along the connector and configured to concentrically nest relative to one another. The supplemental weights are supported by supports on the frame when in the rest position, and they are rotatable, either individually or together, out of engagement with the supports for movement to the operative position. Complementary structures on the top plate and the supplemental weights register to maintain the latter in concentric alignment with the former when in the operative position.

On a fourth embodiment, the supplemental weights are movable along respective frame members disposed beyond opposite sides of the weight stack. Each supplemental weight pivots about a horizontal axis to move between its rest position, wherein the weight is vertical, and its operative position, wherein the weight is horizontal. When both supplemental weights are in the operative position, one rests on top of the other, and registration pegs and holes ensure that both are concentrically aligned relative thereto.

With reference to the fourth embodiment, another aspect of the present invention is to provide an exercise apparatus with a frame and a weight stack movably mounted relative to the frame. The weight stack includes a top plate which is movable along the frame between a lowermost position and an uppermost position. A connector is interconnected between the top plate and a force receiving member. A first supplemental weight is movable along a first side of the frame, and a second supplemental weight is movable along an opposite, second side of the frame. Each supplemental weight is pivotal about a horizontal axis between a rest position, outside the path of the top plate and supported by the frame, and an operative position, supported by the top plate.

On a preferred embodiment of the present invention, the first supplemental weight weighs one-half as much as each plate in the weight stack, and the second supplemental weight weighs one-half as much as the first supplemental weight. As a result, the two supplemental weights are capable of providing three different increments of supplemental weight to the top plate.

On depicted embodiments of the present invention having supplemental weights which are movable along frame members, a relatively large ring of space is provided between the weight and the frame member to minimize contact therebetween during operation of the weight stack. In the alternative, the supplemental weights may be movably mounted on the frame members by means of bearings, low friction plastic, or other suitable arrangements. Also, the foregoing arrangements may be implemented on existing machines, as well as newly manufactured equipment. For example, each of the supplemental weights may include first and second complementary portions which cooperate to form a closed loop about a respective frame member or connector, and which are interconnected by bolts, flexible loop fasteners, or other suitable means.

Yet another possible variation of the present invention is to support the supplemental weight outside the path of the top plate during a first mode of operation; move the supplemental weight onto the top plate during a second mode of operation; and support the supplemental weight at an intermediate position within the path of the top plate during a third mode of operation. In other words, the present invention facilitates conventional weight stack resistance, fractionally increased weight stack resistance which remains constant throughout a range of motion, and/or fractionally increased weight stack resistance which varies during an exercise stroke.

The present invention may also be described in terms of various methods for positioning and/or selecting the supplemental weight(s). Among other things, these methods store the supplemental weight(s) outside of harm's way, yet prevent outright removal of the supplemental weight(s) from the exercise equipment. Many of the features and advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIG. 11 is a partially fragmented, front view of another exercise apparatus assembled according to the principles of the present invention;

FIG. 12 is a partially sectioned, top view of the exercise apparatus of FIG. 11;

FIG. 13 is an exploded, top view of a supplemental weight on the exercise apparatus of FIG. 11;

FIG. 14 is an exploded, partially sectioned, side view of the supplemental weight of FIG. 13;

FIG. 21 is an end view of a supplemental weight handle on the exercise apparatus of FIG. 19;

FIG. 22 is a partially fragmented, front view of another exercise apparatus assembled according to the principles of the present invention;

FIG. 23 is a partially sectioned, top view of the exercise apparatus of FIG. 22;

FIG. 24 is a partially fragmented, front view of another exercise apparatus assembled according to the principles of the present invention; and FIG. 25 is a partially sectioned, top view of the exercise apparatus of FIG. 24.

DETAILED DESCRIPTION OF THE PREFERRED EMBODIMENT

The present invention provides methods and apparatus related to incremental adjustment of weight stack resistance. More specifically, an otherwise conventional weight stack machine is provided with supplemental weights which preferably weigh a fraction of the weights in the stack and are selectively movable into the path of a top weight plate in the stack and/or on top of the top weight plate. The patents identified above in the Background of the Invention are incorporated herein by reference to provide general information regarding weight stack exercise machines and their construction and operation.

On the depicted embodiments of the present invention, a half-weight and a quarter-weight may be added in any combination to the top plate to provide three different incremental adjustments to resistance. In each case, the supplemental weights are designed for concentric alignment relative to the top plate, meaning generally that the weights are specifically configured and/or arranged to distribute mass as evenly as practicable relative to the top plate's center of mass. On the depicted embodiments, each supplemental weight's center of mass is closer to the top plate's center of mass than it is to any outside edge of the top plate. For purposes of calculating each weight's center of mass and/or relating same to other components, the figures are drawn to scale.

Figure 1:
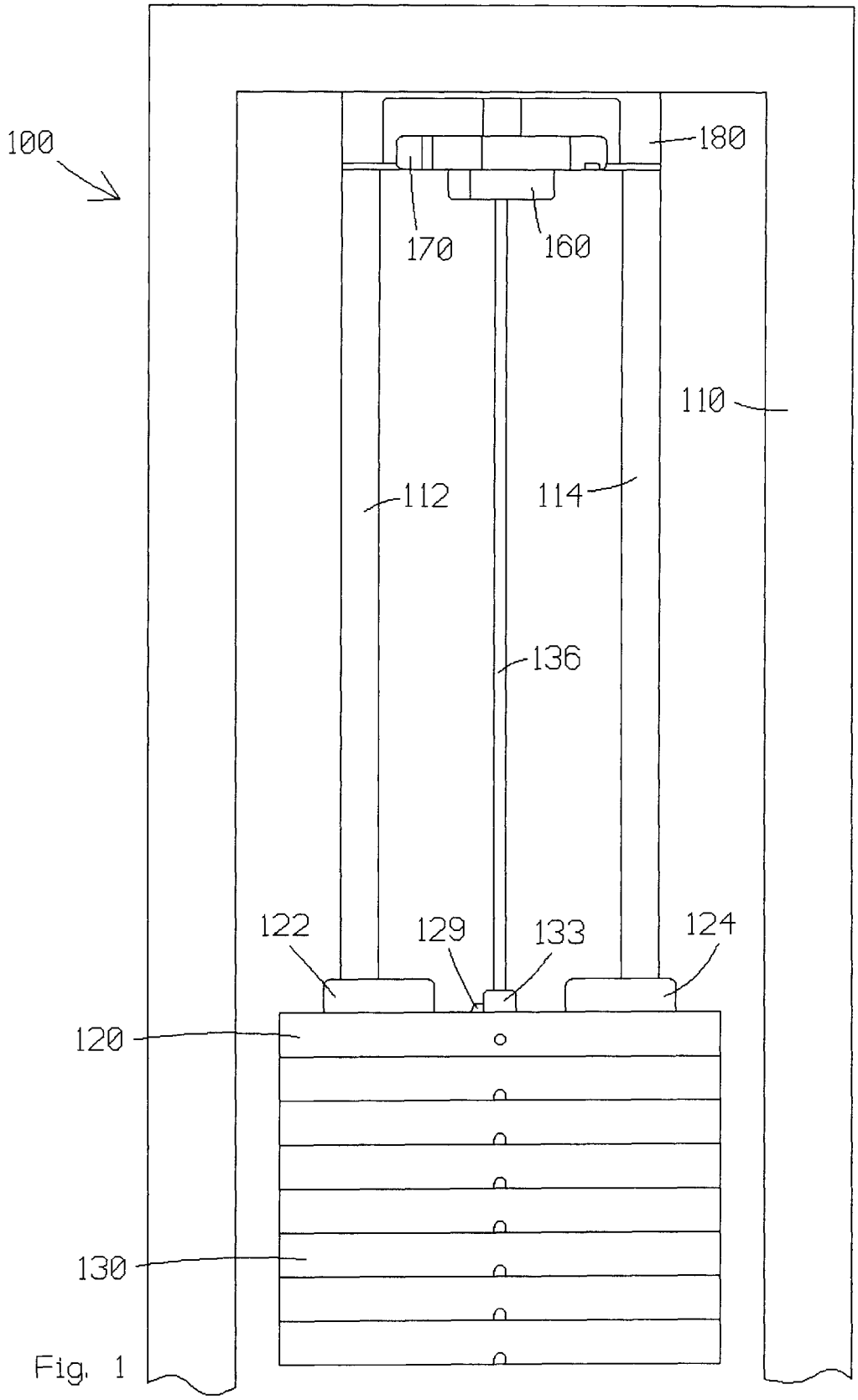
FIG. 1 is a partially fragmented, front view of an exercise apparatus assembled according to the principles of the present invention.
Figure 9:
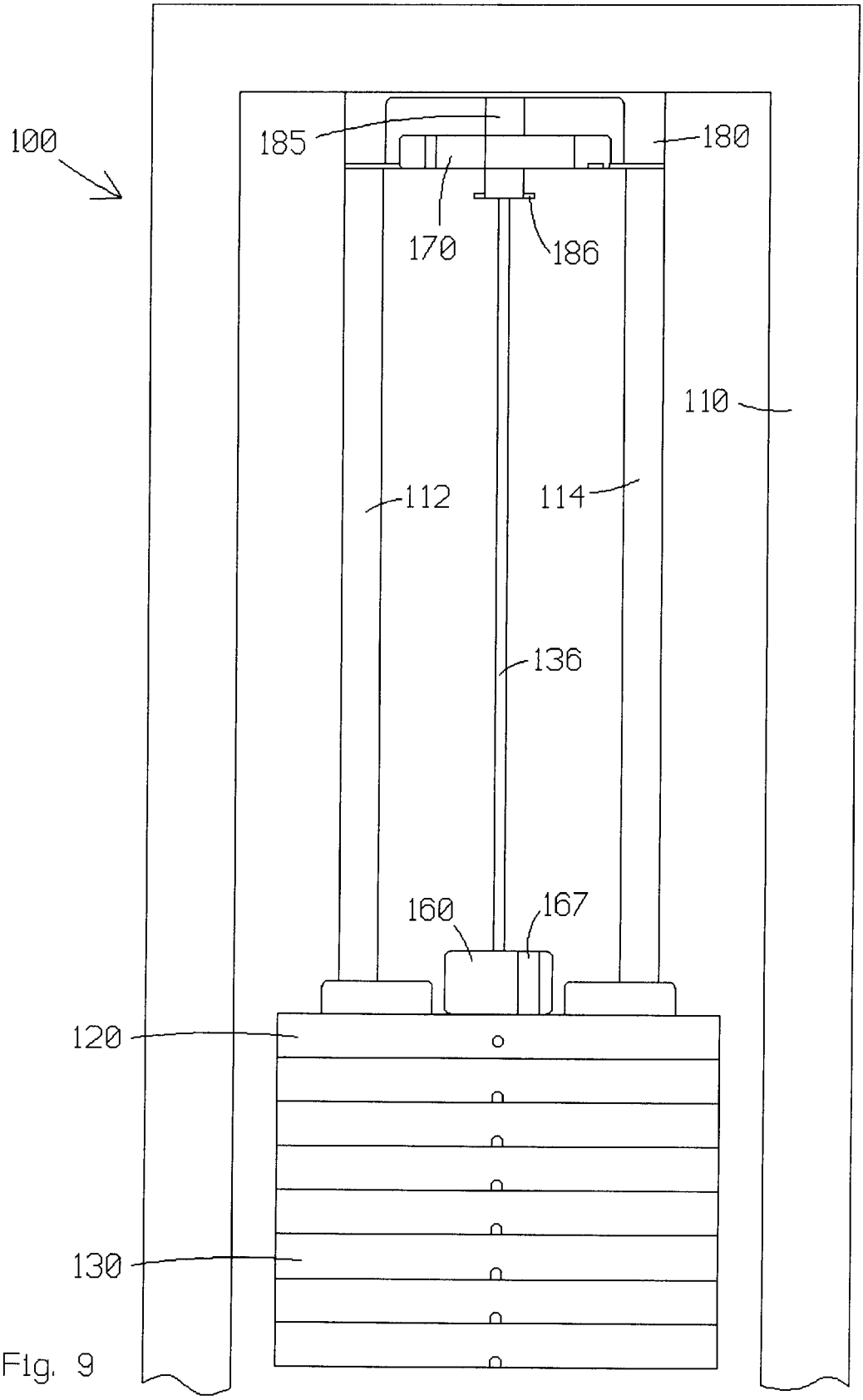
FIG. 9 is a partially fragmented, front view of the exercise apparatus of FIG. 1, with the supplemental weight of FIG. 5 occupying an operative position on top of the top plate of FIG. 6.
Figure 10:
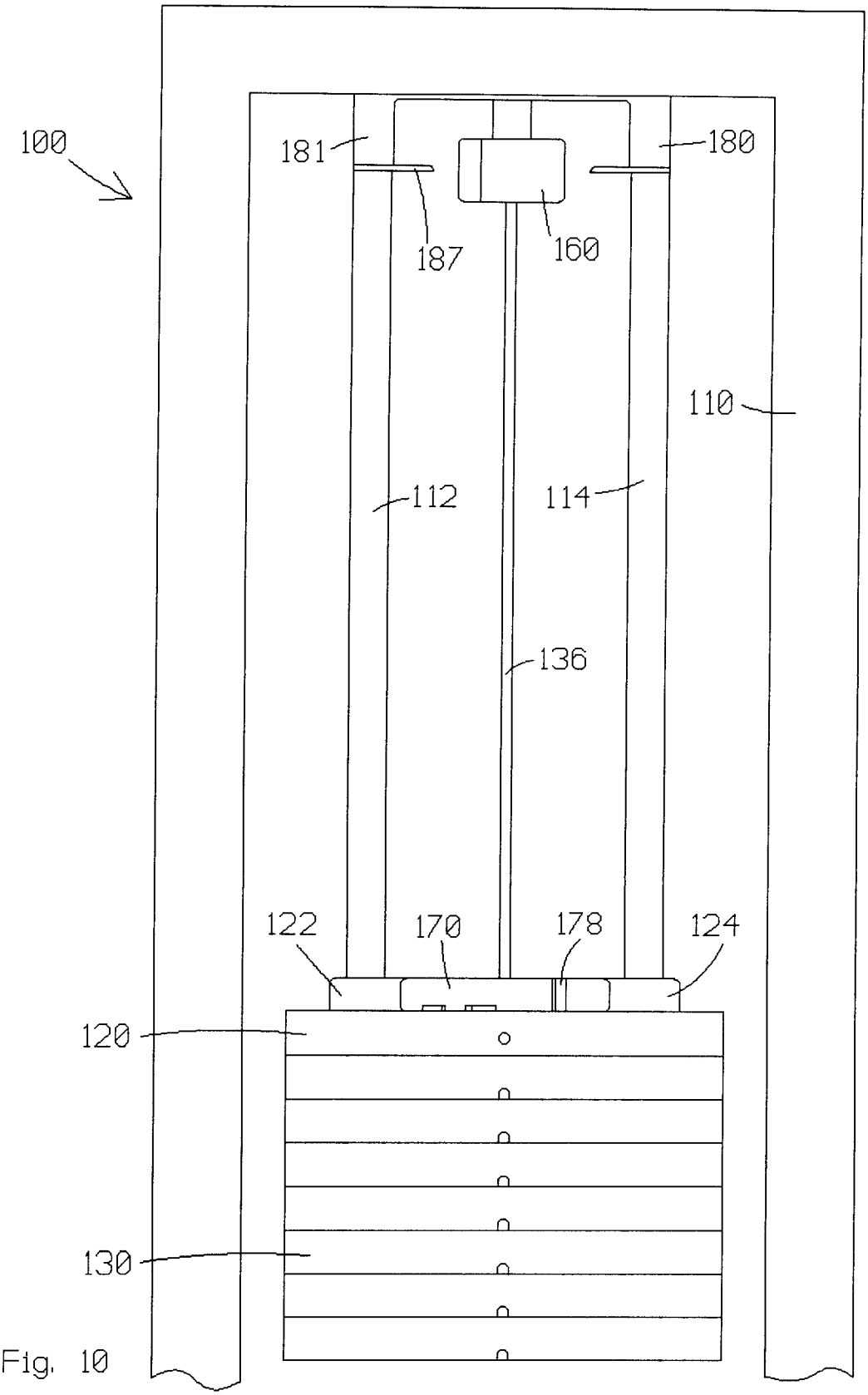
FIG. 10 is a partially fragmented, front view of the exercise apparatus of FIG. 1, with the supplemental weight of FIG. 4 occupying an operative position on top of the top plate of FIG. 6.

A first embodiment of the present invention is designated as 100 in FIGS. 1 and 9–10, and may be described generally as a weight stack exercise machine. The machine 100 generally includes a frame 110 having first and second guides rods 112 and 114. A top plate 120 and additional weight plates are arranged into a vertical stack 130 and movably mounted on the guide rods 112 and 114 by bushings 122 and 124 (or other suitable means known in the art). A selector rod 133 extends through the weight stack 130 and is connected to a force receiving member by a cable 136 (or other suitable means known in the art). The selector rod 133 is selectively connected to any weight in the stack 130 by a selector pin (or other suitable means known in the art).

A weight holder 180 is rigidly mounted on the guide rods 112 and 114 to support supplemental weights 160 and 170 above the path of the top plate 120. The relatively smaller supplemental weight 160 preferably weighs one-fourth as much as a weight plate in the stack 130, and the relatively larger supplemental weight 170 preferably weighs twice as much as the smaller supplemental weight 160. The supplemental weights 160 and 170 are movable along the connector 136 in any combination onto the top plate 120 to provide three incremental adjustments to resistance.

Figure 5:
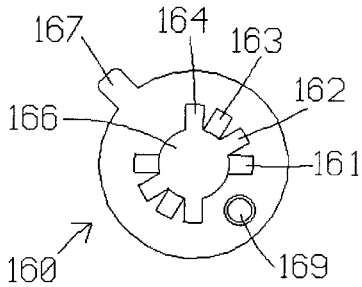
FIG. 5 is a bottom view of the smaller supplemental weight of FIG. 2.

The smaller supplemental weight 160, shown by itself in FIG. 5, may be described as a cylindrical shell with a radially projection ridge 167 which extends the height of the shell. A tapered registration hole 169 extends into the bottom of the weight 160, diametrically opposite the ridge 167. A central hole 166 extends axially through the weight 160 to accommodate the connector 136, which is about one-half as big in diameter as the hole 166 on this embodiment 100. Two pairs of diametrically opposed recesses 161 and 163 are provided in the bottom side of the weight 160, extending radially outward from the central hole 166. Two pairs of diametrically opposed slots 162 and 164 also extend radially in outward from the central hole 166, and the slots 162 and 164 extend axially through the weight 160. The recesses 161 and 163 and the slots 162 and 164 are arranged in alternating fashion, with angles of thirty degrees defined therebetween. Both the recesses 161 and 163 and the slots 162 and 164 are sized and configured to accommodate tabs 186 on the weight holder 180.

Figure 4:
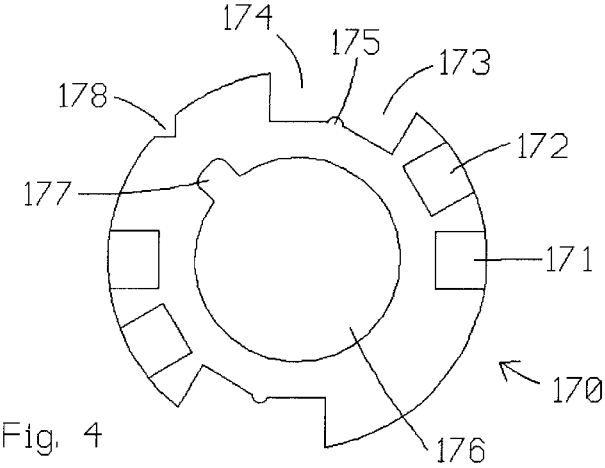
FIG. 4 is a bottom view of the larger supplemental weight of FIG. 2.

The larger supplemental weight 170, shown by itself in FIG. 4, may be described as a cylindrical shell having a relatively larger outside diameter and a relatively smaller height than the smaller supplemental weight 160. A central hole 176 extends axially through the weight 170 to accommodate the smaller weight 160 when the ridge 167 on the smaller weight 160 is aligned with a groove 177 extending radially outward from the hole 176. Two pairs of diametrically opposed recesses 171 and 172 are provided in the bottom side of the weight 170, extending radially inward from the circumference of the weight 170. An angle of thirty degrees is defined between adjacent recesses 171 and 172. Two pairs of diametrically opposed slots 173 and 174 also extend radially inward from the circumference of the weight 170, and the slots 173 and 174 extend axially through the weight 170 with a hump 175 disposed therebetween. The slots 173 and 174 are disposed next to the recesses 171 and 172, with an angle of thirty degrees defined between each slot 173 and adjacent recess 172. In order to provide a visual indication of the orientation of the weight 170, a notch 178 extends into the outer surface of the weight 170 in radial alignment with the groove 177. Both the recesses 171 and 172 and the slots 173 and 174 are sized and configured to accommodate tabs 187 on the weight holder 180.

Figure 2:
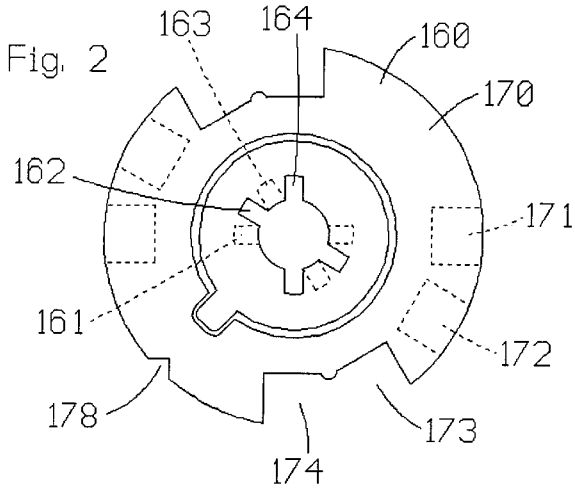
FIG. 2 is a top view of two supplemental weights on the exercise apparatus of FIG. 1.
Figure 3:
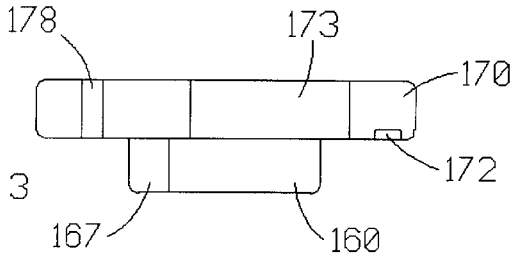
FIG. 3 is a side view of the supplemental weights of FIG. 2.

FIGS. 2 and 3 show the smaller supplemental weight 160 nested inside the larger supplemental weight 170 (with the ridge 167 radially aligned with the groove 177 and the notch 178). When the weights 160 and 170 are aligned with one another, the recesses 161 are radially aligned with the recesses 171, the slots 162 are radially aligned with the recesses 172, the recesses 163 are radially aligned with the slots 173, and the slots 164 are radially aligned with the slots 174. The slots on each weight are somewhat wider than the recesses on the same weight, in order to facilitate clean passage of the tabs 186 or 187 through the former.

Figure 7:
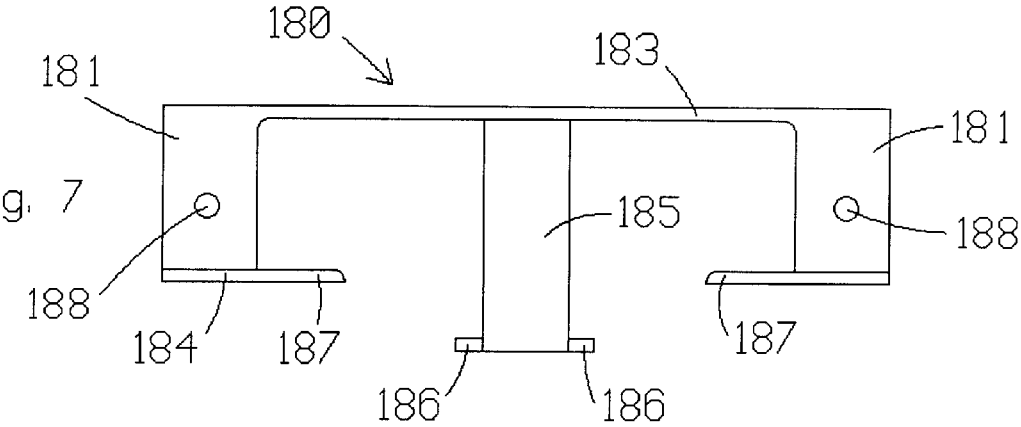
FIG. 7 is a front view of a supplemental weight holder on the exercise apparatus of FIG. 1.
Figure 8:
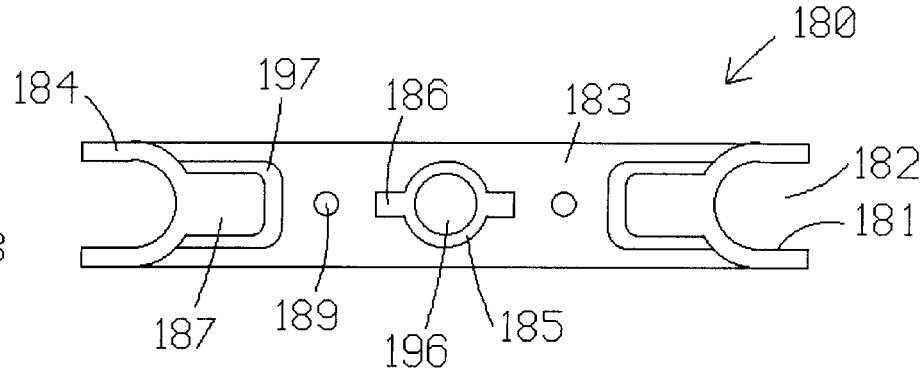
FIG. 8 is a bottom view of the supplemental weight holder of FIG. 7.

The weight holder 180 is shown by itself in FIGS. 7–8. The weight holder 180 has opposite sidewalls 181 which define respective U-shaped channels 182 and are sized and configured to fit snugly onto respective guide rods 112 or 114. Holes 188 extend transversely through opposite sides of the sidewalls 181 to facilitate mounting of the weight holder 180 to the guide rods 112 and 114. The tabs 187 project radially outward from respective sidewalls 181 and toward one another. Reinforcing ribs 184 are integrally joined to opposite sides of each tab 187 and extend about opposite sides of each sidewall 181.

An intermediate strip 183 extends between the upper ends of the two sidewalls 181. Holes 189 extend through the strip 183 to facilitate mounting of the weight holder 180 to an upper portion of the frame 110. Relatively larger openings 197 extend through the strip 183 and align with the tabs 187 to facilitate injection molding of the weight holder 180 as a unitary piece (if desired). A tube 185 extends downward from the center of the strip 183 to support the tabs 186, which are connected to a lower end of the tube 186 and extend away from one another. The tabs 186 are radially aligned with the tabs 187. A central hole 196 extends through the tube 185 and the strip 183 to accommodate the connector 136.

FIG. 1 shows both supplemental weights 160 and 170 in their storage positions relative to the frame 110 (with the recesses 161 aligned with the tabs 186, and the recesses 171 aligned with the tabs 187). When the weights 160 and 170 are lifted and rotated thirty degrees out of the orientation shown in FIG. 1, the slots 162 align with the tabs 186, and the recesses 172 align with the tabs 187, allowing the smaller weight 160 to be lowered into an operative position, on top of the top plate 120 (as shown in FIG. 9). The registration hole 169 fits over a registration peg 129 on the top plate 120 to register the smaller weight 160 relative to the top plate 120.

Figure 6:
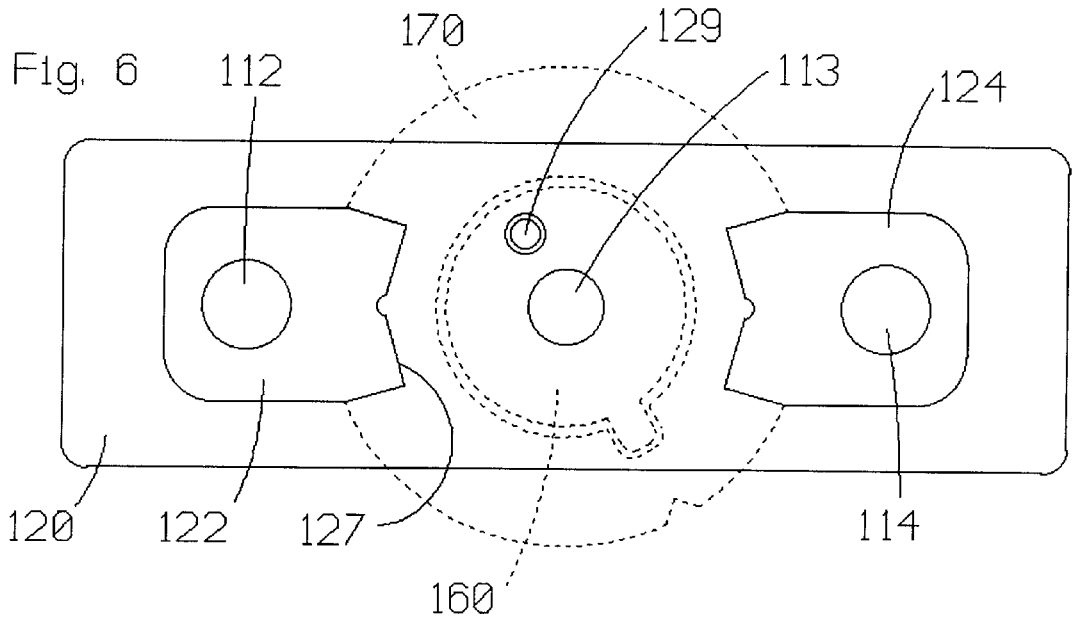
FIG. 6 is a top view of a top plate on the exercise apparatus of FIG. 1, with the supplemental weights of FIG. 2 shown relative thereto in dashed lines.

When the weights 160 and 170 are lifted and rotated sixty degrees out of the orientation shown in FIG. 1, the recesses 163 align with the tabs 186, and the slots 173 align with the tabs 187, allowing the larger weight 170 to be lowered into an operative position, on top of the top plate 120 (as shown in FIG. 10). As shown in FIG. 6 the bushings 122 and 124 are provided with opposing surfaces 127 which are contoured to interface with the slots 173 and 174 and humps 175 on the larger weight 170, thereby registering the larger weight 170 relative to the top plate 120. FIG. 6 also shows that the registration hole 169 in the smaller weight 160 aligns with the registration peg 129 on the top plate 120 when the larger weight 170 is properly aligned relative to the bushings 122 and 124. These registration arrangements hold respective supplemental weights in concentric alignment with the top plate 120.

When the weights 160 and 170 are lifted and rotated ninety degrees out of the orientation shown in FIG. 1, the slots 164 align with the tabs 186, and the slots 174 align with the tabs 187, allowing both weights 160 and 170 to be lowered into an operative position, on top of the top plate 120. As a result of their distinct sizes and shapes, the weights 160 and 170 may be handled and/or maneuvered simultaneously or individually, as circumstances may dictate.

A second embodiment of the present invention is designated as 200 in FIGS. 11–12, and also may be described generally as a weight stack exercise machine. The machine 200 includes a frame 210 designed to rest upon a floor surface. First and second guide rods 212 and 214 extend vertically between lower and upper ends of the frame 210. A top plate 220 and underlying weight plates are arranged into a vertical stack 230 and movably mounted on the guide rods 212 and 214. When not in use, the weight stack 230 rests against a shock absorbing member on the lower end of the frame 210.

A selector rod 233 extends through the weight stack 230, is secured to the top plate 220, and may be selectively connected to any desired plate in the stack 230 by a selector pin (or other suitable means known in the art). A cable 236 extends from an upper end of the selector rod 233 to one or more force receiving members which operate in a manner known in the art. As a result, movement of a force receiving member is resisted by gravity acting on the selected number of plates.

First and second supplemental weights 251 and 252 are movable along respective frame members 202 and 204. The mass of the weight 252 is twice the mass of the weight 251, but in all other respects the two weights 251 and 252 are similar in construction and operation. Each of the weights 251 and 252 includes a relatively heavy member or plate 260 (designated as 260' on the weight 252 because it is relatively thicker), and a relatively light handle and/or guide member 270. The components 260 and 270 of the weight 251 are shown individually in FIGS. 13 and 14.

The heavy member 260, which is preferably cast iron or steel, may be described as U-shaped with an outside perimeter comparable to that of the top plate 220. The base portion 267 of the plate 260 has a relatively narrower cross-section and/or may be described as a tongue which fits into a cavity 277 in the handle 270, preferably in such a manner that the upper surfaces on the handle 270 and the plate 260 are flush with one another. A registration peg 263 extends downward from each prong of the plate 260, relatively nearer the distal ends of the prongs, to align the plate 260 relative to the top plate 220 or the plate 260' on the other weight 252. An opening 262 extends downward into each prong of the plate 260, relatively nearer the base end, to accommodate similar pegs 263 on the other weight 252. A lifting tab 265 extends transversely outward from one of the prongs on the plate 260 to facilitate handling of the weight 251.

The handles 270, which are preferably molded plastic, form "loose fitting" closed loops about respective frame members 202 and 204. Each of the handles 270 includes parallel sidewalls 272 which straddle a respective frame member 202 or 204, and are interconnected by two transversely extending members 274 and 276 disposed on opposite sides of the frame member. Slots 279 are provided in the sidewalls 272, opposite a respective plate 260 or 260', for purposes described below. The plates 260 and 260' are secured to respective handles 270 by any suitable means known in the art, including adhesives and/or rivets extending perpendicular through the tongues of the plates 260 and 260', for example.

A first weight holder 280 is mounted on the frame member 202 for purposes of supporting the weight 251 in a storage position outside the path of the top plate 220. The holder 280 is preferably a molded plastic piece having a U-shaped sidewall which fits like a sleeve about the frame member 202, and a U-shaped platform 288 which extends perpendicular to the frame member 202. The sidewall is secured to the frame member 202 by rivets 281 or other suitable means. Reinforcing ribs are interconnected between the sidewall and the platform 288 to enhance the structural integrity of the holder 280. Flanges 289 extend upward from the platform 288 on opposite sides of the frame member 202 to interengage the slots 279 in the weight handle 270 when the weight 251 is resting in its storage position on the platform 288 (not shown in FIGS. 11–12). The weight 251 is movable to the operative position shown in FIGS. 11–12, on top of the top plate 220, simply by lifting the weight 251 upward from the holder 280 and rotating the weight 251 into alignment with and on top of the top plate 220 (as shown in FIGS. 11–12). In this operative position, the weight 251 is freely movable together with the top plate 220, and its center of mass is relatively close to the connector 236.

An alternative, second weight holder 290 is mounted on the frame member 204 for purposes of supporting the weight 252 in a storage position outside the path of the top plate 220. The holder 290 is preferably a metal rod formed into a generally C-shaped configuration. The opposite ends and intermediate portion of the holder 290 are secured to the frame member 204 by welding or other suitable means. The relatively shorter, opposite side segments of the holder 290 interengage the slots 279 in the weight handle 270 when the weight 252 is resting in its storage position on the relatively longer, intermediate segment of the holder 290 (as shown in FIGS. 11–12). The weight 252 is movable to an operative position, on top of the top plate 220, in the same manner as the other weight 251. In the operative position (not shown in FIGS. 11–12), the weight 252 is also freely movable together with the top plate 220, and its center of mass is also relatively close to the connector 236. The weights 251 and 252 are configured in such a manner that either holder 280 or 290 may be used with either weight 251 or 252. Moreover, those skilled in the art will recognize that the weights 251 and 252 may be held in additional ways without departing from the scope of the present invention.

Figure 15:
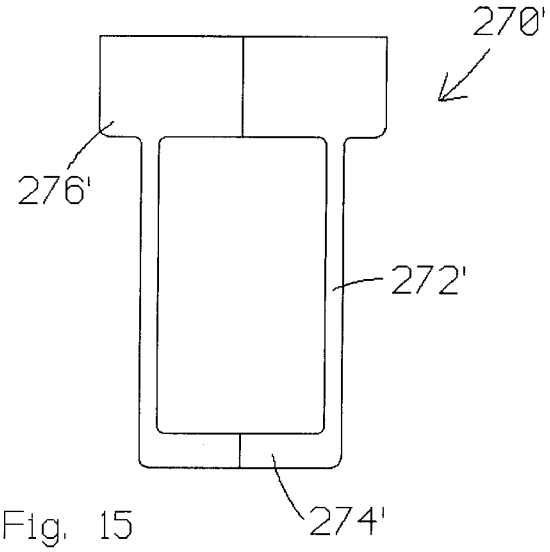
FIG. 15 is a top view of another supplemental weight handle suitable for use on the exercise apparatus of FIG. 11.
Figure 16:
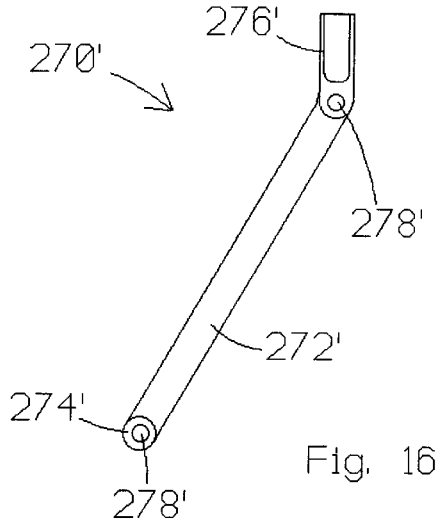
FIG. 16 is a side view of one half of the handle of FIG. 15.

FIGS. 15–16 show an alternative embodiment weight handle 270' suitable for retrofit installation without access to either end of the frame members 202 or 204. The handle 270' is preferably made of plastic and includes two similar halves, one of which is shown in FIG. 16. Each half of the handle 270' includes parallel strips 272' which extend between respective rod portions 274' and respective plate engaging portions 276'. Pegs 278' on one half of the handle 270' register with holes in the other half of the handle 270' to facilitate assembly. The two halves may be secured together by welding, adhesives, or other suitable means known in the art.

Figure 17:
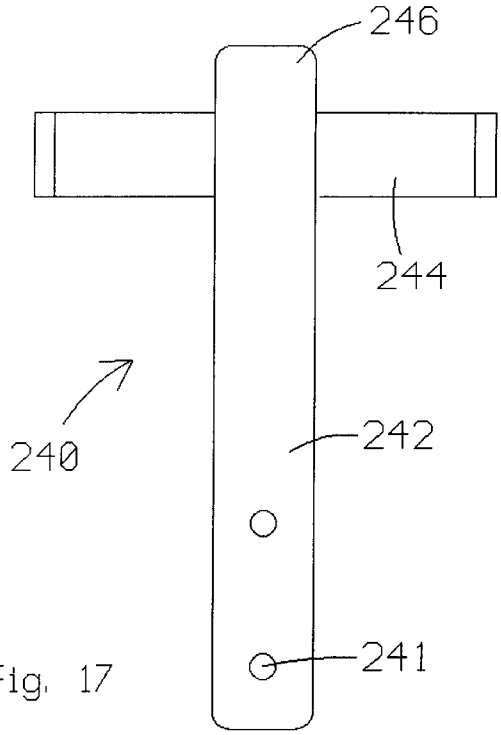
FIG. 17 is a front view of a supplemental weight holder suitable for use on the exercise apparatus of FIG. 11, together with the handle of FIG. 15.
Figure 18:
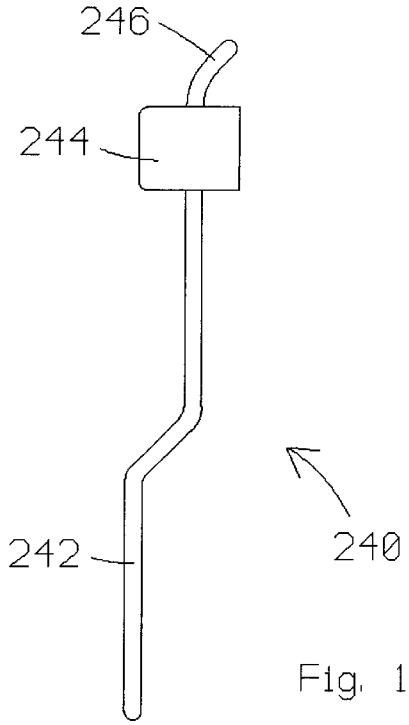
FIG. 18 is a side view of the holder of FIG. 17.

FIGS. 17–18 show a weight holder 240 suitable for use with the handle 270'. The weight holder 240 is preferable made of sheet metal and includes a longitudinal strip 242 and a transverse strip 244. Holes 241 extend through a lower portion of the longitudinal strip 242 to facilitate mounting to a respective frame member 202 or 204. An opposite, upper end 246 of the strip 242 is flared away from the frame member 202 or 204 to facilitate pivoting of a supplemental weight relative thereto. An intermediate portion of the longitudinal strip 242 is configured to engage the plate engaging portions 276' of the handle 270', and the transverse strip 244 is configured to engage the prongs of an associated plate.

Figure 20:
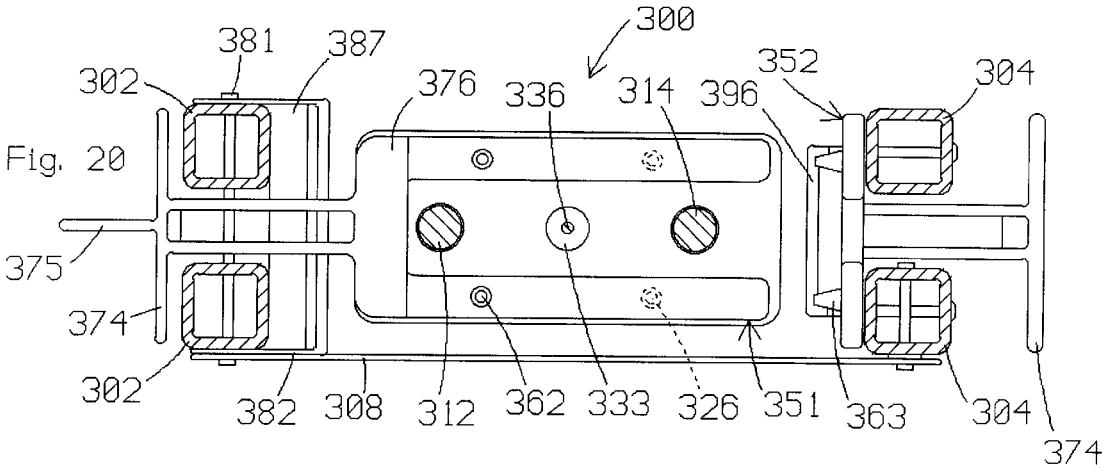
FIG. 20 is a partially sectioned, top view of the exercise apparatus of FIG. 19.
Figure 19:
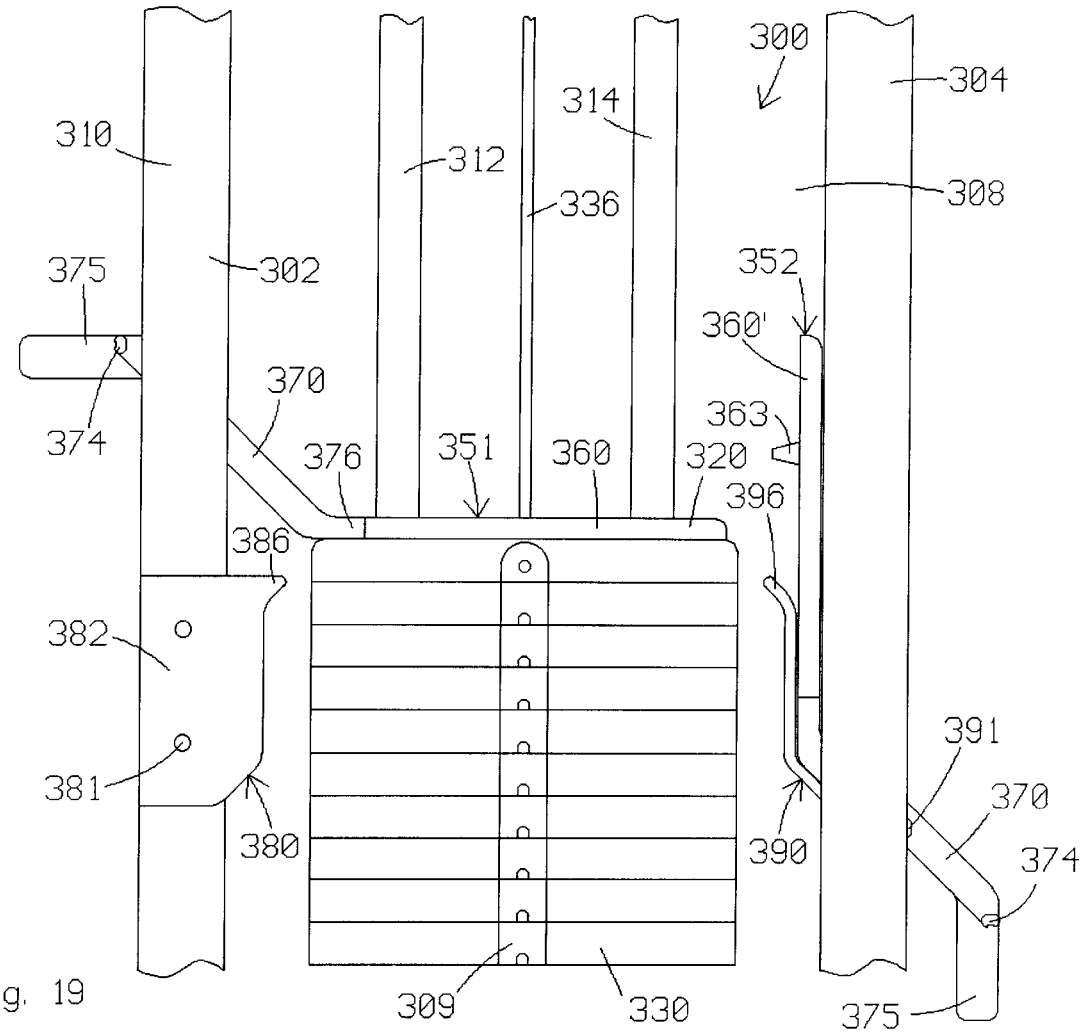
FIG. 19 is a partially fragmented, front view of another exercise apparatus assembled according to the principles of the present invention.

FIGS. 19 and 20 show another weight stack exercise machine 300 assembled in accordance with the principles of the present invention, and similar in some respects to the previous embodiment 200. The machine 300 generally includes a weight stack 330, including top plate 320 and a plurality of underlying plates, movably mounted on guide rods 312 and 314. A selector rod 333 extends through the weight stack and is connected to a force receiving member by a cable 336 (or other suitable means known in the art).

A shield 308 spans the front of the machine 300 and effectively separates a user of the machine 300 from the guide rods 312 and 314 and the weight stack 330. A central slot 309 is provided in a lower portion of the shield 308 to facilitate insertion of a selector pin into engagement with any desired weight plate in the stack 330. This embodiment 300 requires a selector pin which inserts entirely inside the shield 308, since the slot 309 does not extend along the entire path of the weight plates. However, the present invention is not limited to any particular arrangement for selecting the weights in the stack 330.

First and second supplemental weights 351 and 352 are movable along respective pairs of frame members 302 and 304. The mass of the weight 352 is twice the mass of the weight 351 (the plate 360' and its prongs are about twice as wide), but in all other respects the two weights 351 and 352 are similar in construction and operation. Each of the weights 351 and 352 includes a relatively heavy member or plate 360 (designated as 360' on the weight 352 because it is wider), and a relatively light handle or guide member 370.

The heavy member 360, which is preferably cast iron or steel, may be described as U-shaped with a perimeter comparable to that of the top plate 320. The intermediate, base portion 367 of the plate 360 has a relatively narrower cross-section and/or may be described as a tongue which fits into a similarly shaped cavity 377 in the handle 370, preferably in such a manner that the upper surfaces on the handle 370 and the plate 360 are flush with one another. Registration pegs 363 extend downward from respective prongs of the plate 360, relatively nearer the distal ends of the prongs, to align the plate 360 relative to the top plate 320 or the plate 360' on the other weight 352. Openings 362 extend downward into respective prongs of the plate 360, relatively nearer the base end, to accommodate similar pegs 363 on the other weight 352.

One of the handles 370 is shown by itself in FIG. 21. The handle 370, which is preferably molded plastic, is retained between adjacent frame members 302 or 304. The handle 370 includes an intermediate throat or stem 372 which extends between the frame members 302 or 304 and is interconnected between two transversely extending members 374 and 376 disposed on opposite sides of the frame members 302 or 304. A tab 375, shown in FIGS. 19–20, extends perpendicularly away from the member 374, generally opposite the stem 372 to facilitate handling of a respective weight 351 or 352. The plates 360 and 360' are secured to respective handles 370 by any suitable means known in the art, including adhesives, snap fit, and/or rivets extending perpendicular through the tongues of the plates 360 and 360', for example.

A first weight holder 380 is mounted on the frame members 302 for purposes of supporting the weight 351 in a storage position outside the path of the top plate 320. The holder 380 is preferably a molded plastic piece having a U-shaped profile which parallels opposite sides of the frame members 302 and is secured thereto by rivets 381 or other suitable means. The holder 380 is contoured to guide the weight 351 into and out of engagement therewith, with an upper flange 386 on the holder 380 serving as a pivot point or ledge for the weight 351. The holder 380 effectively defines an open-ended compartment 387, shown in FIG. 20, which holds the weight 351 in its storage position (not shown in FIGS. 19–20). The weight 351 is movable to the operative position shown in FIGS. 19–20, on top of the top plate 320, simply by lifting the weight 351 upward from the holder 380 and rotating the weight 351 into alignment with and on top of the top plate 320 (as shown in FIGS. 19–20). In this operative position, the weight 351 is freely-movable together with the top plate 320, and its center of mass is proximate the connector 336.

An alternative, second weight holder 390 is mounted on the adjacent frame members 304 for purposes of supporting the weight 352 in a storage position outside the path of the top plate 320. The holder 390 is preferably a metal rod formed into a generally U-shaped configuration which is similar to the contour of the first holder 380. The opposite ends 391 of the holder 390 are inserted through respective frame members 304 and secured in place by welding, bolts, and/or other suitable means. The holder 390 effectively cradles the weight 352 in its storage position (as shown in FIGS. 19–20). The weight 352 is movable to an operative position, on top of the top plate 320, in the same manner as the other weight 351, with the upper cross-member 396 serving as a pivot point or ledge. In the operative position (not shown in FIGS. 19–20), the weight 352 is also freely movable together with the top plate 320, and its center of mass is also relatively close to the connector 336. The weights 351 and 352 are configured in such a manner that either holder 380 or 390 may be used with either weight 351 or 352. Also, the top plate 320 may be configured to facilitate pivoting of the weights 351 and 352, and/or other suitable methods may be used to support the weights 351 and 352 without departing from the scope of the present invention.

FIGS. 22 and 23 show another weight stack exercise machine 400 assembled in accordance with the principles of the present invention. The machine 400 generally includes a weight stack, including a top plate 420 and a plurality of underlying plates, movably mounted on guide rods 412 and 414. A selector rod 433 extends through the weight stack and is connected to a force receiving member by a cable 436 (or other suitable means known in the art).

First and second supplemental weights 460 and 470 are movable along respective guide rods 412 and 414. The mass of the weight 470 is twice the mass of the weight 460, but in all other respects the two weights 460 and 470 are similar in construction and operation. Each of the weights 460 and 470 includes first and second blocks 461 and 463 which are interconnected by an elongate strip 464. The resulting configuration has a center of mass which generally coincides with that of the top plate 420. A hole 462 extends through the block 461 to facilitate unencumbered travel of the weight 460 along the guide rod 412. Registration openings 466 in the weight 460 align with registration pegs 426 on the top plate 420 to hold the weight 460 in the position shown in FIG. 23, spaced apart from the guide rods 412 and 414 and the selector rod 433. Similar registration openings 467 in the weight 470 align with similar registration pegs 427 on the top plate to hold the weight 470 in the position shown in FIG. 23, spaced apart from the guide rods 412 and 414 and the selector rod 433.

When not in use, the weights 460 and 470 are supported by a holder or hooked member 480. A hole 481 extends through a base portion, of the holder 480 to facilitate mounting on an upper portion of the machine frame. First and second J-shaped members 487 extend downward from opposite ends of the base portion and open away from one another. Each weight 460 and 470 is movable to a rest position, wherein a respective strip 464 is supported by a respective J-shaped member 487. The weights 460 and 470 are rotatable about respective guide rods 412 and 414 into and out of engagement with respective J-shaped members 487. The weights 460 and 470 may be moved in any order between rest positions (outside the path of the top plate 420) and operative positions (within the path of the top plate 420).

FIGS. 24 and 25 show another weight stack exercise machine 500 assembled in accordance with the principles of the present invention. The machine 500 generally includes a weight stack, including a top plate 520 and a plurality of underlying plates, movably mounted on guide rods 512 and 514. A selector, rod 533 extends through the weight stack and is connected to a force receiving member by a cable 536 (or other suitable means known in the art).

First and second supplemental weights 560 and 570 are movable along the connector 536. The mass of the weight 570 is twice the mass of the weight 560. The weight 560 is a rectangular block having a central rectangular opening which facilitates unencumbered travel along the connector 536. The weight 560 has a center of mass which approximately coincides with that of the top plate 520. On opposite ends of the weight 560, recesses extend into the bottom side of the weight 560 to facilitate registration of the weight 560 relative to ledges 586 on weight holders 58.0 (when in a rest position) and relative to bosses 526 on the top plate 520 (when in an operative position).

The weight 570 is also a rectangular block having a central opening which facilitates both unencumbered travel along the connector 536 and movement of the smaller weight 560 through the larger weight 570. The weight 570 also has a center of mass which approximately coincides with that of the top plate 520. On opposite ends of the weight 570, recesses extend into the bottom side of the weight 570 to facilitate registration of the weight 570 relative to ledges 587 on weight holders 580 (when in a rest position) and relative to bosses 526 on the top plate 520 (when in an operative position). Notches 578, which are somewhat larger than the recesses, extend through weight 570 adjacent the recesses, and tabs 579 project outward from the weight 570 at the same peripheral locations as the notches 578.

When not in use, the weights 560 and 570 are supported by holders or hooked members 580 mounted on an upper portion of the machine frame. The holders 580 include opposing ledges 586 which project toward one another at a first elevation to support the smaller weight 560, and opposite ledges 587 which project away from one another at a second elevation to support the larger weight 570. Each weight 560 and 570 is movable to a rest position, supported by respective ledges 586 or 587. The weight 560 is tilted, as suggested by arrow A6 in FIG. 24, to free the weight 560 from the holders 580 for movement to its operative position. The weight 560 is moved laterally, as suggested by arrow A7 in FIG. 25, to free the weight 570 from the holders 580 for movement to its operative position. The weights 560 and 570 may be moved in any order between rest positions (outside the path of the top plate 520) and operative positions (within the path of the top plate 520).

The foregoing description not only references specific embodiments and methods, but will also lead those skilled in the art to recognize additional embodiments, methods, improvements, combinations, and/or applications. Among other things, one or more features of a particular embodiment may be suitable for use on another embodiment, either alone or in combination with features from still other embodiments. Also, on some of the embodiments, the supplemental weights may be movably connected to dedicated, flexible guide members (interconnected between the top plate and an upper portion of the frame) either in addition to or rather than the connector cable and/or the weight stack guide rods. In view of the foregoing, the scope of the present invention is to be limited only to the extent of the following claims.

What is claimed is:

1. An exercise apparatus, comprising:

a frame;

a stack of weights movably mounted on the frame, wherein the stack includes a top plate which is movable along a path; and a supplemental weight mounted for operative movement along a frame member and selectively movable between a rest position, wherein the weight is supported in a vertical orientation outside the path of the top plate, and an operative position, wherein the weight is supported in a horizontal orientation within the path of the top plate.

2. The exercise apparatus of claim 1, wherein the supplemental weight includes a generally U-shaped mass.

3. The exercise apparatus of claim 1, wherein the supplemental weight includes a handle.

4. The exercise apparatus of claim 1, wherein the supplemental weight and the top plate include respective portions which register with one another when the supplemental weight occupies the operative position.

5. The exercise apparatus of claim 1, further comprising a support mounted on the frame and configured to support the supplemental weight in the rest position.

6. The exercise apparatus of claim 1, wherein the supplemental weight is concentrically aligned with the top plate when in the rest position.

7. The exercise apparatus of claim 1, wherein the frame member is disposed outside a perimeter defined by the top plate.

8. An exercise apparatus, comprising:

a frame;

a stack of weights movably mounted on the frame, wherein the stack includes a top plate which is movable along a path;

first and second supplemental weights mounted for operative movement along the frame and movable in any order between respective rest positions, outside the path of the top plate, and respective operative positions, within the path of the top plate and concentrically aligned with the top plate.

9. The exercise apparatus of claim 8, wherein the supplemental weights are mirror images of one another.

10. The exercise apparatus of claim 8, wherein one of the supplemental weights weighs twice as much as the other.

11. The exercise apparatus of claim 8, wherein respective portions of the supplemental weights and the top plate are configured to register with one another.

12. The exercise apparatus of claim 11, wherein respective portions of the supplemental weights are configured to register with one another.

13. The exercise apparatus of claim 8, wherein respective portions of the supplemental weights are configured to register with one another.

14. The exercise apparatus of claim 8, wherein each of the supplemental weights is movable along a respective frame member.

* * * * *